United States Patent [19]

Henson

[11] 4,168,559

[45] Sep. 25, 1979

[54] CLEANING DEVICE

[76] Inventor: Bobby G. Henson, Box 1556, Tryon, N.C. 28782

[21] Appl. No.: 890,521

[22] Filed: Mar. 27, 1978

[51] Int. Cl.[2] ..... A46B 13/02

[52] U.S. Cl. ..... 15/23

[58] Field of Search ..... 15/23, 24, 28, 29, 97 R, 15/103

[56] References Cited

U.S. PATENT DOCUMENTS

| | | | |
|---|---|---|---|
| 1,474,994 | 11/1923 | Brown | 15/23 |
| 1,951,851 | 3/1934 | Turner | 15/23 |
| 3,724,016 | 4/1973 | Soffer | 15/24 |
| 3,751,749 | 8/1973 | Wilson | 15/23 |

*Primary Examiner*—Edward L. Roberts

*Attorney, Agent, or Firm*—Wellington M. Manning, Jr.; Luke J. Wilburn, Jr.

[57] ABSTRACT

A cleaning device for removing leaves and other debris from elevated structures such as gutters. An elongated support handle is provided with a quick-release coupling at an upper end thereof. A curved support member is removably secured to the elongated support member and has a power means, such as an electric motor provided at an opposite end thereof. A shaft extending from the electric motor is provided with a plurality of elongated, flexible elements to engage, dislodge, or comminute leaves and other debris in gutters or other elevated structures during operation of same. Universal joints along the curved upper support member permit the placement of the power means in such fashion to move under nails or the like that are used to support the gutters and secure same to a housing structure. Normal operation of the power means disposes the shaft vertically with the elongated, flexible members rotating in a horizontal plane. The support elements may be tubular in construction, and a further attachment provided for the elongated support to seal an end of a downspout from a gutter, whereby water may be forced through the elongated support member and into the downspout to clear same of debris, if necessary.

16 Claims, 6 Drawing Figures

CLEANING DEVICE

BACKGROUND OF THE INVENTION

Building structures with gutters present a periodic cleaning problem, particularly where the gutters are located more than one story above the ground, directly over shrubbery that is substantial in size, or that is otherwise, relatively inaccessible for cleaning. Historically, gutters have been cleaned by ascending a ladder and physically removing leaves, pine needles and other debris therefrom to permit an unimpeded flow of water from the roof, into the gutter, and along the gutter into an appropriate downspout. Such general cleaning is not only time consuming, but is particularly hazardous. In fact, many individuals have been injured, some even killed, by falls from a ladder in attempting to clean a gutter at the top of a first story or second story dwelling. Moreover, certain individuals are affected with vertigo, and thus have a fear of height whereby they would not even attempt to clean the gutters. If the gutters are not periodically cleaned and they continue to fill up with leaves, pine needles or other debris, the effect of the gutter to divert the flow of water from the roof to a suitable location for disposal is thwarted. Further, the extra weight produced by debris in the gutter could disassociate the gutter from the dwelling structure. Still further, accumulation of foreign material in the gutter could cause the gutter to rust, whereby the purpose of the gutter is again thwarted.

The present invention provides a system whereby one may conveniently clean a gutter without the danger of a fall. Moreover, the device, due to its particular construction, may be suitably used by virtually anyone to clean a gutter at a first or second story level in a safe fashion, and in an efficient fashion. Foreign matter in the gutter is comminuted or otherwise broken up to a point where it may be safely flushed through a downspout and into a storm drain or onto the ground at the bottom of the downspout. In either case, the procedure for cleaning the gutter is substantially advanced over the conventional technique of the hand cleaning while perched atop a ladder.

One system does exist for a motorized cleaning of a gutter structure, though different from the present invention. In particular, the other system, as disclosed in U.S. Pat. No. 3,751,749 provides a rotary shaft rotating in a direction axial to the length of the gutter with relatively stiff beater arms thereon for forcing debris out of the gutter where it is permitted to free fall therefrom. The present invention is believed to be patentably distinct over the system of U.S. Pat. No. 3,751,749 and has definite advantages thereover during use as exemplified hereinafter. Additional prior art known to applicant is listed as follows, none of which is believed to be more pertinent than the disclosure of the U.S. Pat. No. 3,751,749 set forth above.

U.S. Pat. No. 1,476,969; U.S. Pat. No. 1,893,979; U.S. Pat. No. 1,951,851; U.S. Pat. No. 3,537,113; U.S. Pat. No. 3,605,135; U.S. Pat. No. 3,751,749; U.S. Pat. No. 3,937,404;Canada Pat. No. 689,059; Great Britain Pat. No. 1,188,517.

SUMMARY OF THE INVENTION

It is an object of the present invention to provide an improved system for cleaning elevated structures such as gutters and the like.

Yet another object of the present invention is to provide a lightweight, portable system useable from ground level to clean gutters and other elevated structures without endangering the user of same.

Still further, another object of the present invention is to provide a system for comminuting or otherwise breaking up debris found in restricted elevated structures to permit easy removal of same therefrom.

Generally speaking, the apparatus of the present invention is directed to a cleaning unit comprising an elongated rigid support element; a curved upper support section secured to an upper end of said elongated support element for movement thereabout; and a power means secured to said upper section at an opposite end thereof, said power means having a rotatable shaft extending therefrom, said shaft having a plurality of flexible elongated members secured thereto for rotary movement with said shaft to engage debris within said structure and dislodge or comminute said debris, said shaft being normally rotatable in a direction transverse to the length of a structure being cleaned.

More particularly, the cleaning device of the present invention utilizes an elongated rigid support element such as a tubular pipe that is lightweight to facilitate use of same by one standing on the ground and which in a preferred embodiment, has a valve means therealong with an actuator for the valve doubling as a handle for the support element. The curved upper section is securable to the upper end of the rigid support element, preferably by means of a quick release coupling with the curved section having at least one universal joint therealong. A power means such as an electric, hydraulic, or air motor is provided at an outer free end of the curved support section with a capability of universal movement thereabout. The rotatable shaft is secured to the power means and extends outwardly therefrom, having a plurality of spaced apart, elongated, flexible elements secured thereto. The normal direction of rotation of the shaft is in a plane parallel to the rigid support element, though the universal movement of the power means facilitates a change in the plane of rotation of the shaft to permit flexible elements secured thereto to comminute debris in protected areas or to pass under support members for the gutter structures.

In a preferred embodiment of the present invention, the rotatable shaft is provided with a rotatable support at a lower end of same. The shaft support is designed to ride along the bottom of the gutter or other elevated structure, and due to its rotational movement to assist in both supporting the weight of the cleaning unit and simultaneously, due to the rotational movement of same, assisting to permit easy movement of the cleaning device along the gutter.

The cleaning unit of the present invention, as mentioned above, involves an elongated support that is preferably tubular with a valve means located therealong where an actuator for the valve doubles as a handle for the support element. In this context, a further attachment may be provided on an independent upper curved support unit that is attachable to the elongated support element and has as its outer free end a plug for a downspout. The plug is generally made of a resilient material that may be forced into the top of the downspout to provide a seal thereat. A source of water may then be attached to the lower end of the elongated support element whereby water can controllably pass therethrough and into the downspout, creating water pressure sufficient to dislodge any leaves or other debris that may be received therein.

DESCRIPTION OF THE PREFERRED EMBODIMENTS

Figures 1, 2, 3, 4:
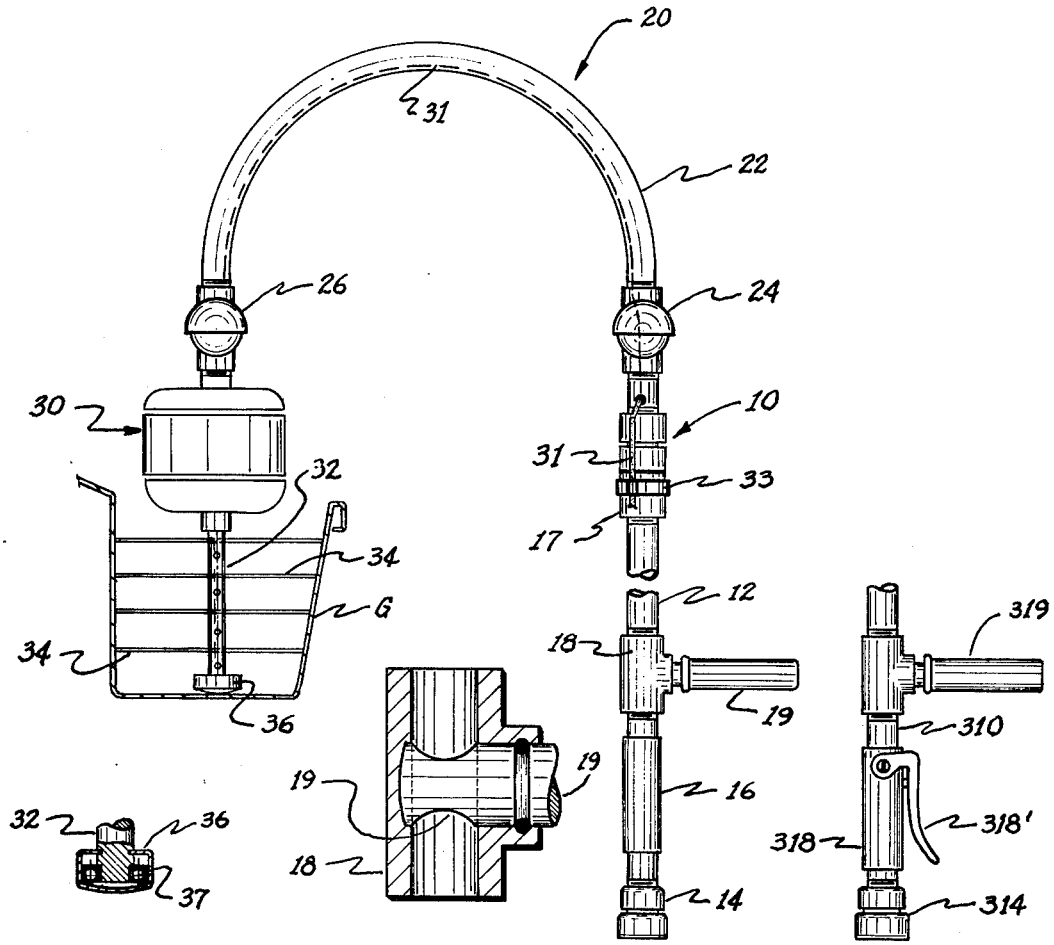
FIG. 1 is an elevational view of a cleaning unit, according to the teachings of the present invention.
FIG. 2 is a side view of a portion of the elongated support element showing a modification thereto.
FIG. 3 is a broken away enlarged view of a section of the elongated support element showing a water valve means modification therefor.
FIG. 4 is an enlarged partial view of the rotatable shaft according to the teachings of the present invention showing the rotatable support means therefor.

Making reference to the Figures, preferred embodiments of the present invention will now be described in detail. FIG. 1 illustrates a cleaning device according to the teachings of the present invention wherein an elongated, tubular support means generally indicated at 10 is provided having an upper curved support member generally indicated as 20 secured to an upper end thereof with the upper curved support member 20 having a motor or power means generally indicated as 30 secured at an outer end of same. Elongated support member 10 is preferably represented by a tubular element 12 that generally would range in length from six to twenty feet or more, but has been substantially shortened to facilitate illustration. Tubular element 12 should be strong enough to provide relatively rigid support to the cleaning unit of the present invention while being light enough to permit ease of use. Aluminum tubing is preferred. A lower end of tubular element 12 is provided with an adaptor 14 to facilitate connection of a water hose or other source of water (not shown) to a lower end of elongated support 10, the purpose of which will be described in detail hereinafter. Above the hose adaptor 14 is an enlarged covering 16 that serves as a convenient handle means for one using the device. Further, located along tubular element 12 is a valve means 18 which has a valve handle or actuator 19 extending transversely to the length of tubular element 12 and which further also serves as a support handle. Use of the valve means 18 will likewise be described in detail hereinafter. Elongated support element 10 is provided with a coupling connection 17 at an upper end thereof, with coupling 17 preferably being of a conventional quick coupling type. Preferred quick coupling 17 facilitates ease of connection and removal of curved upper support 20 to elongated support element 10 or the affixation of other attachments as will be hereinafter described.

Upper curved support 20 like elongated tubular element 10 is preferably of tubular construction and comprises a curved tubular element 22 which may be provided with a first universal joint 24 adjacent the end of support 20 that is coupled to elongated support element 10 and a second universal coupling 26 at an opposite end of curved support 20.

Figure 6:
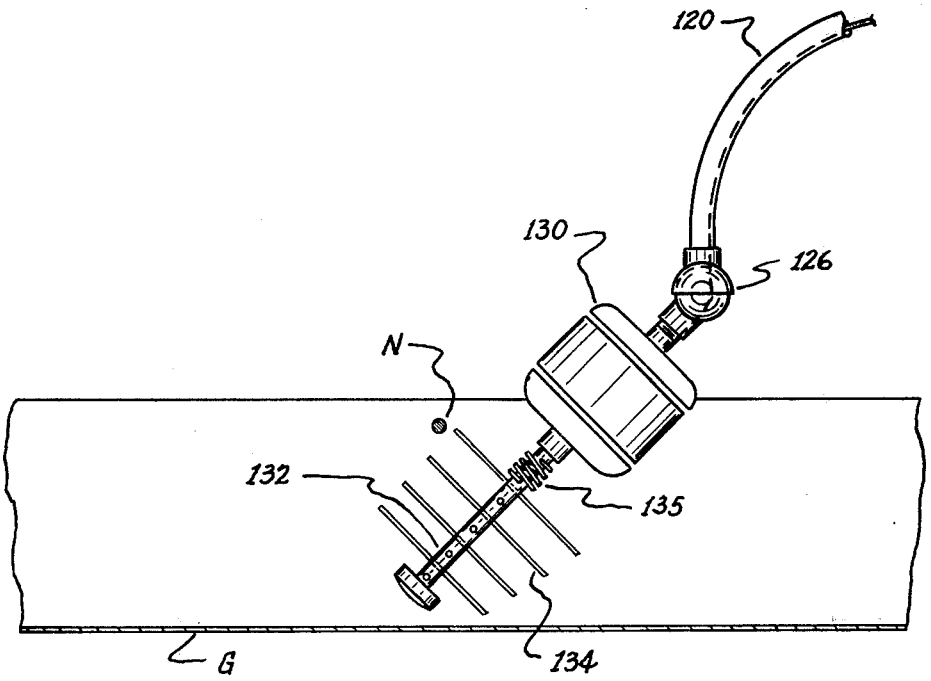
FIG. 6 is a vertical cross sectional view of a gutter illustrating a feature of the cleaning device of the present invention.

The power means for the cleaning device of the present invention is generally indicated as 30 and is secured to curved support 20 adjacent universal coupling or joint 26 and depends downwardly therefrom. Motor 30 has a shaft 32 secured thereto with shaft 32 extending outwardly therefrom and having a plurality of elongated flexible filaments or the like 34 secured therealong. Preferably, as illustrated in FIGS. 1 and 6, flexible filaments 34 extend in transverse direction with respect to shaft 32. In a most preferred arrangement, the filaments 34 adjacent an upper end of the shaft are longer than those adjacent a lower end of the shaft. Moreover, in a most preferred embodiment, shaft 32 has a rotatable support element 36 secured thereto at a lower end thereof.

As illustrated in FIG. 1, power means 30 may be connected to a source of electrical or other power to provide motive force for same in any convenient fashion. An electrical conductor 31, for example, could be utilized in connection with an electric motor and could pass through curved upper support 20 extending outwardly from same at an end adjacent the point of coupling to elongated support element 10 and thereafter be clipped or otherwise secured to support element 10 by suitable bands 33 or the like. A terminal end of the conductor 31 (not shown) will, of course, be provided with appropriate connector means to associate same with a suitable source of electricity. In like fashion, should the power means be hydraulic or air, a suitable power supply line could be substituted for the electrical conductor being handled in the same fashion. Alternatively, the electrical line could pass completely through the tubular portions of the support elements and extend outwardly therefrom adjacent the hose adaptor 14. Since it is conceivable that water could be utilized within tubular element 10, it would be, of course, very necessary to provide adequate waterproofing or other suitable protection to the conductor 31 to preclude the possibility of an electrical shock.

With the device as illustrated in FIG. 1, an individual using same could stand on the ground, hold the elongated tubular support element 10 at the appropriate handle connections 16 and 19 and hold the device up to position the motor shaft 32 within a gutter that requires cleaning. With motor 30 operating, shaft 32 will rotate and will cause flexible elements 34, which preferably are monofilament nylon, to rotate and engage leaves, pine needles or other similar debris, and comminute same within the gutter. Rotatable support 36 for motor shaft 32 will, of course, take most of the weight of the device off the arms of the individual using same and transfer the weight to the bottom of the gutter. Due to its rotational movement, support 36 will also promote movement of the device along the gutter G. As can be seen from the cross sectional view of the gutter G in FIG. 1, gutter G tapers somewhat towards the lower end. In this arrangement, it is preferred that the flexible elements 34 likewise should be shorter in length towards an outer free end of motor shaft 32 to generally conform to the cross sectional configuration of the gutter in which is being used.

A portion of a cleaning device according to the teachings of the present invention is illustrated in use in FIG. 6 with a portion of the gutter G cut away. Since, under normal circumstances, the gutter on a dwelling will extend completely across a front or rear section of the dwelling or along another roof segment, intermediate support for the gutter is required, such as by an extremely long nail which passes across the top of the gutter and is secured in a portion of the dwelling. Since these intermediate supports extend completely across the top of the gutter structure, they of course, will impede normal passage of the present cleaning device along the length of the gutter. In FIG. 6, a portion of an upper curved support element 120 is shown, having a motor 130 secured thereto adjacent a universal joint 126. Once a support nail N is approached, the operator of the device by manipulating same can cause motor 130, motor shaft 132 and the associated flexible elements 134 to pivot around universal joint 126 and thus extend under the nail to act on the debris thereunder. As shown in FIG. 6, shaft 132 may be provided intermediate its length with a spring or other flexible element 135 to further facilitate moving the flexible elements 134 around obstructions along the gutter. After appropriate cleaning of the section of gutter beneath the support nail, the cleaning device of the present invention can be withdrawn, lifted above the nail and moved further along the gutter structure. In this fashion, the entire length of a gutter affixed to a dwelling can be very conveniently and very quickly cleaned. The comminuted debris may be washed from the gutter.

Each gutter along a dwelling house is further provided with a downspout D (See FIG. 5) at ends of the house or at various medial locations therealong to permit water from the gutter to pass downwardly therethrough to the ground. In general, the downspouts D are constructed of similar material to that of the gutters and are secured thereto with an opening G' in the bottom of the gutter, leading into the downspout. Downspouts themselves are subject to becoming clogged due to the presence of debris normally found in a gutter and from time to time must be cleaned.

Figure 5:
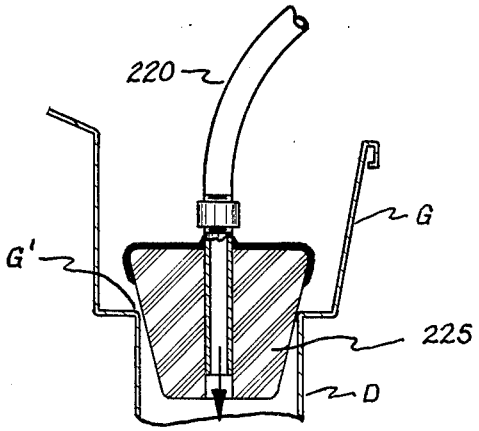
FIG. 5 is a partial view of an upper curved section of the cleaning unit showing the plug attachment for cleaning out a downspout.

The device of the present invention is thus capable of receiving a further attachment as illustrated in FIG. 5 where a hollow, curved upper support element 220 is secured to the elongated support element (not shown) and has a plug 225 of a resilient material secured around a lower portion of same with plug 225 having a central support element 220 and further to permit the passage of water therethrough. Upper curved support member 220 as shown in FIG. 5 would not require universal joints in the fashion as presented for upper curved support member 20 of FIG. 1. Instead, it would be represented by a continuous tubular element which would then be coupled to the elongated support element in like fashion as shown in FIG. 1. With the plug 225 being secured around an outer free end of curved support 220 and a source of water provided for support member 10 by virtue of a hose being connected to elongated support member 10 at adaptor 14, water can be supplied to the downspout. With the plug presented at the downspout, a slight tugging action on the device will cause the plug to deform due to its resilient construction and properly seat in and seal the top of the downspout. Water may then be admitted by manipulation of valve handle 19 to place opening 19' in axial alignment with respect to the length of the tubular element 10 to permit the passage of water therethrough (FIG. 3). Once water has been admitted along tubular element 10, it will continue to pass through the support structure including the tubular upper curved support 220 and pass through plug 225 into the downspout D where the water pressure will dislodge materials accumulated therein and flush the downspout. Thereafter, easy passage of water and debris through the downspout D is apparent. The device of the present invention may thus be utilized to clean both the gutter and downspout of a dwelling without the hazards attendant to conventional cleaning techniques.

Furthermore, in FIG. 2 an additional embodiment is shown where a valve 318 of different construction is provided having a separate handle means 318' secured for pivotal movement thereat. While the internal configuration of valve 318 is not illustrated, it is conventional in the art for use with water hoses or the like and needs no further description at this point.

Due to the length of the elongated support element 10 and the presence of a power means or motor 30 at an upper end thereof, it is desirable that the unit of the present invention weigh as little as possible to facilitate mobility by the user and likewise to avoid unduely tiring the user who is continuing to hold same in position in a gutter. As such, aluminum tubing is preferred for the support elements as mentioned above. A lightweight aluminum motor 30 is also preferred. As such, the total weight of the unit in use is not excessive whereby same can be utilized effectively by both men and women. As shown in FIGS. 1 and 4, motor shaft 32 has a support 36 secured to an outer free end of same. Support 36 is secured around shaft 32 by a bearing arrangement 37 and has rounded or smooth outer edges. Support 36 transfers a substantial portion of the weight of the cleaning device to the gutter. Also the rotation of support 36 coupled with its streamlined outer edges permits ease of movement of the cleaning device along the gutter.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A cleaning device for elevated structures comprising:
   (a) an elongated, rigid support element;
   (b) a curved upper section secured to an upper end of said support element;
   (c) a power means secured to said curved upper section at an opposite end thereof, said power means having a rotatable shaft extending therefrom, said shaft having a plurality of flexible members secured thereto for rotary movement with said shaft to engage debris within said structure and dislodge or masticate said debris.

2. A cleaning device as defined in claim 1 wherein said shaft is hollow.

3. A cleaning device as defined in claim 1 wherein said curved upper section has at least one joint therealong to permit pivotal movement of said power means about said joint.

4. A cleaning device as defined in claim 1 wherein the flexible members are synthetic polymeric filaments.

5. A cleaning device as defined in claim 1 wherein flexible members are secured to said shaft along a major portion of the length thereof, said members decreasing in length downwardly along the shaft, in conformity with the cross section of said structure.

6. A cleaning device as defined in claim 1 further comprising rotary support means secured to an outer free end of said shaft.

7. A cleaning device as defined in claim 1 further comprising handle means secured to said elongated support.

8. A cleaning device as defined in claim 1 wherein said elongated support is tubular and has hose securement means provided at a lower end of same.

9. A cleaning device as defined in claim 8 wherein said elongated support means has valve means therealong.

10. A cleaning device for gutters comprising:

(a) an elongated support means;

(b) a curved upper support section secureable to said elongated support section at an upper end thereof, said curved upper support having a universal joint therealong;

(c) a power means secured to a free outer end of said curved upper support at said universal joint; and (d) an elongated rotatable shaft secured for rotation at said power means, said shaft having a plurality of elongated flexible members secured thereto, said shaft having rotatable support means secured to an end thereof.

11. A cleaning device as defined in claim 10 wherein said power means is an electric motor.

12. A cleaning device as defined in claim 11 further comprising an electrical conductor connected to said motor and being secured along said support members, said conductor being connectable to a source of electricity at a free end thereof.

13. A cleaning device as defined in claim 10 wherein said elongated support is tubular in structure.

14. A cleaning device as defined in claim 10 wherein said flexible members on said shaft are synthetic polymeric monofilaments.

15. A cleaning device as defined in claim 10 wherein the rotatable shaft has means associated therewith to permit said shaft to deflect.

16. A cleaning device for an elevated structure comprising:

(a) an elongated rigid support element, said suppoort element having a curved section adjacent an end of same, said curved section being receivable at said elevated structure;

(b) a rotatable shaft received at an outer free end of said curved section of said support element, said shaft having at least one flexible element secured thereto, said at least one flexible element being rotatingly engageable with debris within said structure to dislodge or masticate same; and (c) power means associated with said rotatable shaft for imparting rotation to same.

* * * * *